US006928902B1

(12) United States Patent
Eyssallenne

(10) Patent No.: US 6,928,902 B1
(45) Date of Patent: Aug. 16, 2005

(54) AIR POWERED WRENCH DEVICE WITH PIVOTABLE HEAD AND METHOD OF USING

(76) Inventor: Luis P. Eyssallenne, 83 Mokema Ave., Waltham, MA (US) 02451

( * ) Notice: Subject to any disclaimer, the term of this patent is extended or adjusted under 35 U.S.C. 154(b) by 20 days.

(21) Appl. No.: 10/392,757

(22) Filed: Mar. 20, 2003

(51) Int. Cl.[7] ..... B25B 17/00
(52) U.S. Cl. ..... 81/57.26; 81/57.44
(58) Field of Search ..... 81/57.26, 57.44, 81/57.29, 57.11, 57.42, 57.43, 54

(56) References Cited

U.S. PATENT DOCUMENTS 4,512,221 A * 4/1985 Picone ..... 81/170
5,784,934 A * 7/1998 Izumisawa ..... 81/57.26
6,050,989 A * 4/2000 Fox et al. ..... 606/1
6,311,583 B1 * 11/2001 Izumisawa ..... 81/57.13
6,435,060 B1 * 8/2002 Izumisawa ..... 81/57.39

* cited by examiner

*Primary Examiner*—Derris H. Banks
*Assistant Examiner*—J Williams

(57) ABSTRACT

An air powered wrench device with a pivotable head and associated method of using. The device comprises a handle pivotally attached to an arm. The handle comprises a housing, an air intake nozzle, an air driven motor, a drive shaft, a ball bearing collar, a universal joint, an on/off button, a trigger switch, a directional throw switch, a lock pin, a spring, and a pivot post. The arm is pivotally attached to the handle via the pivot post. The arm includes: an outer casing, an extension rod, a ball bearing sleeve, a first pawl gear, a second pawl gear, and a bit connector. The method of using the device comprises the steps of adjoining, affixing, aligning, allowing, enshrouding, getting, moving, obtaining, putting, rotating, shifting, squeezing, and tightening.

1 Claim, 4 Drawing Sheets

AIR POWERED WRENCH DEVICE WITH PIVOTABLE HEAD AND METHOD OF USING

FIELD OF THE INVENTION

The present invention relates hand tools, more particularly, to an air powered wrench device with a pivotable head and a associated method of using the device.

DESCRIPTION OF THE PRIOR ART

Wrenches having a straight fixed head are difficult to use in tight spaces which are often readily accessible by wrenches having a head located at an angled position relative to a body of the wrench. Many currently available wrenches that have an adjustable head typically require the head to be moved away from the body to adjust the position of the head relative to the body. This is inconvenient since it generally requires two hands to adjust the head and requires the wrench to be moved away from the fastener the wrench is being used to loosen or tighten.

A separate but related problem, particularly associated with power wrenches is the transmission of power through a pivot point. A power wrench currently available with an adjustable head has a continuous flexible drive shaft extending from the body to the head. Since the shaft is subject to constant bending, the shaft is susceptible to fatigue over a period of time. The pivot connection of the head of the wrench to its body is structurally separate from the drive shaft, as is the mechanism for locking the head in a selected angular position relative to the body. Thus the wrench has several different parts required for pivoting, adding to the complexity and weight of the wrench.

A wide variety of wrench devices is currently available on the commercial market and an even larger number of these types of devices are known in the art of wrench devices, for example, the power driven replacement socket ratchet wrench disclosed by Anderson et al. in U.S. Pat. No. 4,993,288; the ratchet drive tool with manual and non-manual power actuation disclosed by Evans in U.S. Pat. No. 5,251,706; the ratchet wrench with pivotable head disclosed by Izumisawa in U.S. Pat. No. 5,784,934; the angularly adjustable powered surgical handpiece disclosed by Fox et al. in U.S. Pat. No. 6,050,989; the ratchet wrench with pivotable head disclosed by Izumisawa in U.S. Pat. No. 6,311,583; and the pneumatic hand tool disclosed by Izumisawa in U.S. Pat. No. D408,243.

While all of the above-described devices fulfill their respective, particular objectives and requirements, the aforementioned patents do not describe a wrench device having a a handle pivotally attached to an arm in which the handle comprises a housing, an air intake nozzle, an air driven motor, a drive shaft, a ball bearing collar, a universal joint, an on/off button, a trigger switch, a directional throw switch, a lock pin, a spring, and a pivot post and the arm includes: an outer casing an extension rod, a ball bearing sleeve, a first pawl gear, a second pawl gear, and a bit connector. This combination of elements would specifically match the user's particular individual needs of making it possible to perform the operational steps of adjoining, affixing, aligning, allowing, enshrouding, getting, moving, obtaining, putting, rotating, shifting, squeezing, and tightening. The above-described patents make no provision for a wrench device having a handle pivotally attached to an arm in which the handle comprises a housing, an air intake nozzle, an air driven motor, a drive shaft, a ball bearing collar, a universal joint, an on/off button, a trigger switch, a directional throw switch, a lock pin, a spring, and a pivot post and the arm includes: an outer casing an extension rod, a ball bearing sleeve, a first pawl gear, a second pawl gear, and a bit connector.

Therefore, a need exists for a new and improved wrench device having a handle pivotally attached to an arm in which the handle comprises a housing, an air intake nozzle, an air driven motor, a drive shaft, a ball bearing collar, a universal joint, an on/off button, a trigger switch, a directional throw switch, a lock pin, a spring, and a pivot post and the arm includes: an outer casing an extension rod, a ball bearing sleeve, a first pawl gear, a second pawl gear, and a bit connector. In this respect, the wrench device according to the present invention substantially departs from the conventional concepts and designs of the prior art, and in doing so provides an apparatus primarily developed for the purpose of providing a means for adjoining, affixing, aligning, allowing, enshrouding, getting, moving, obtaining, putting, rotating, shifting, squeezing, and tightening.

SUMMARY OF THE INVENTION

The present device and method of using, according to the principles of the present invention, overcomes the shortcomings of the prior art by providing a wrench device and associated method of using are disclosed. The device comprises a handle pivotally attached to an arm. The handle comprises a housing, an air intake nozzle, an air driven motor, a drive shaft, a ball bearing collar, a universal joint, an on/off button, a trigger switch, a directional throw switch, a lock pin, a spring, and a pivot post. The arm is pivotally attached to the handle via the pivot post. The arm includes: an outer casing, an extension rod, a ball bearing sleeve, a first pawl gear, a second pawl gear, and a bit connector. The method of using the device comprises the steps of adjoining, affixing, aligning, allowing, enshrouding, getting, moving, obtaining, putting, rotating, shifting, squeezing, and tightening.

In view of the foregoing disadvantages inherent in the known type wrench devices now present in the prior art, the present invention provides an improved wrench device, which will be described subsequently in great detail, is to provide a new and improved wrench device which is not anticipated, rendered obvious, suggested, or even implied by the prior art, either alone or in any combination thereof.

To attain this, the present invention essentially comprises a a housing, an air intake nozzle, an air driven motor, a drive shaft, a ball bearing collar, a universal joint, an on/off button, a trigger switch, a directional throw switch, a lock pin, a spring, and a pivot post. The arm is pivotally attached to the handle via the pivot post. The arm includes: an outer casing an extension rod, a ball bearing sleeve, a first pawl gear, a second pawl gear, and a bit connector.

There has thus been outlined, rather broadly, the more important features of the invention in order that the detailed description thereof that follows may be better understood, and in order that the present contribution of the art may be better appreciated.

The invention may also include a protection skirt. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wrench device that has all the advantages of the prior art wrench device and none of the disadvantages.

It is another object of the present invention to provide a new and improved wrench device that may be easily and efficiently manufactured and marketed.

An even further object of the present invention is to provide a new and improved wrench device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new wrench device that provides in the apparatuses and methods of the prior art some of the advantages thererof, while simultaneously overcoming some of the disadvantages normally associated therewith.

Even still another object of the present invention is to provide a wrench device having a a handle pivotally attached to an arm in which the handle comprises a housing, an air intake nozzle, an air driven motor, a drive shaft, a ball bearing collar, a universal joint, an on/off button, a trigger switch, a directional throw switch, a lock pin, a spring, and a pivot post and the arm includes: an outer casing an extension rod, a ball bearing sleeve, a first pawl gear, a second pawl gear, and a bit connector. This combination of elements makes it possible to provide a wrench device capable of performing the operational steps of adjoining, affixing, aligning, allowing, enshrouding, getting, moving, obtaining, putting, rotating, shifting, squeezing, and tightening.

Lastly, it is an object of the present invention to provide a new and improved method of using comprising the steps of adjoining, affixing, aligning, allowing, enshrouding, getting, moving, obtaining, putting, rotating, shifting, squeezing, and tightening.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
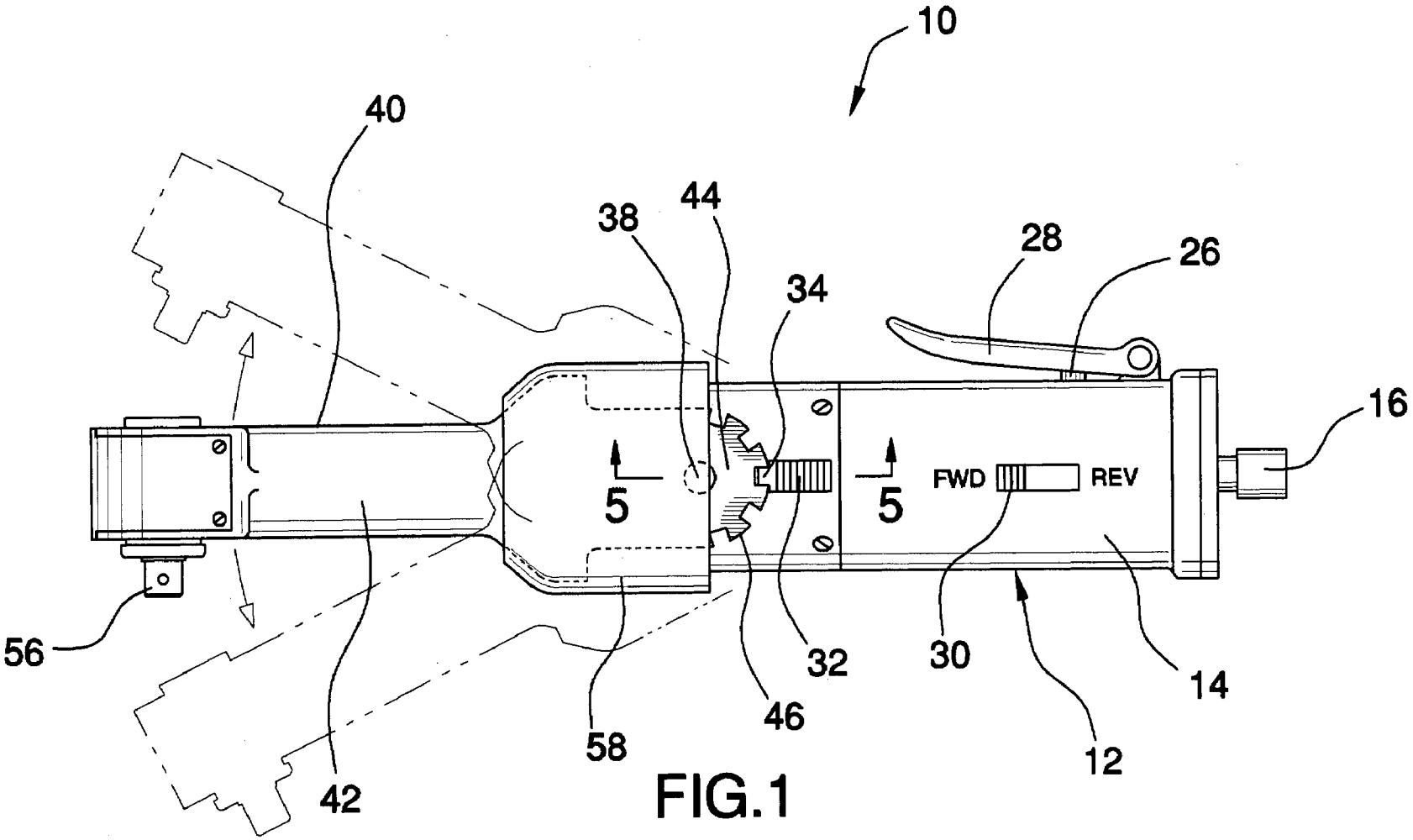
FIG. 1 is a side plan view of an preferred embodiment of the wrench device constructed in accordance with the principles of the present invention.

Referring now to the drawings, and in particular FIGS. 1 to 5 thereof, one preferred embodiment of the present invention is shown and generally designated by the reference numeral 10. One preferred embodiment of an air wrench device 10 comprises a handle 12 pivotally attached to an arm 40. The handle 12 includes: a housing 14, an air intake nozzle 16, an air driven motor 18, a drive shaft 20, a ball bearing collar 22, a universal joint 24, an on/off button 26, a trigger switch 28, a directional throw switch 30, a lock pin 32, a spring 36, and a pivot post 38. The an air intake nozzle 16 is attached to the housing 14, the housing 14 having a distal end and a proximate end. The air driven motor 18 is attached to the proximate end of the housing 14, in which the air driven motor 18 is operatively attached to the air intake nozzle 16. The drive shaft 20 is operatively attached to the air driven motor 18. The ball bearing collar 22 is attached to the proximate end of the housing 14, in which the ball bearing collar 22 is operatively attached to the drive shaft 20. The universal joint 24 is operatively attached to the drive shaft 20. The on/off button 26 is attached to the housing 14, in which the on/off button 26 is operatively attached to the air driven motor 18. The trigger switch 28 is pivotally attached to the housing 14, in which the trigger switch 28 is operatively attached to the on/off button 26. The directional throw switch 30 is attached to the housing 14, in which the directional throw switch 30 is operatively attached to the air driven motor 18. When the directional throw switch 30 is slid into a first position then the drive shaft 20 is enabled to rotate in a clockwise direction. When the directional throw switch 30 is slid in a second position then the drive shaft 20 is enabled to rotate in a counterclockwise direction. The lock pin 32 is slidably attached within a crevice in the distal end of the housing 14, in which the lock pin 32 has an engagement head 34. When the lock pin 32 is slid toward the proximate end of the housing 14 then the lock pin 32 is in an unlocked alignment. When the lock pin 32 is slid towards the distal end of the housing 14 then the lock pin 32 is in a locked alignment. The spring 36 is attached to the housing 14 and is attached to the lock pin 32, wherein when the lock pin 32 is in the unlocked alignment then the spring 36 is in a compressed mode. The pivot post 38 is attached to the distal end of the housing 14. The arm 40 includes: an outer casing 42, an extension rod 48, a ball bearing sleeve 50, a first pawl gear 52, a second pawl gear 54, and a bit connector 56. The outer casing 42 has a distal end and a proximate end, in which the distal end of the outer casing 42 has a cogwheel 44. The cogwheel 44 is pivotally attached to the pivot post 38 of the handle 12, wherein the cogwheel 44 has a plurality of flanges 46 attached along the circumference of the cogwheel 44 so that each adjacent pair of flanges 46 defines a corresponding recess between the adjacent pair of flanges 46. The engagement head 34 of the lock pin 32 is insertable into anyone recess of the cogwheel 44, so that when the engagement head 34 of the lock pin 32 is inserted within anyone recess of the cogwheel 44 then the arm 40 is in a lock position relative to the handle 12, and when the engagement head 34 of the lock pin 32 is not inserted within anyone recess of the cogwheel 44 then the arm 40 is rotatable about the pivot post 38. The extension rod 48 is operatively attached to the universal joint 24 of the handle 12. The ball bearing sleeve 50 is attached to the outer casing 42, in which the ball bearing sleeve 50 operatively attached to the extension rod 48. The first pawl gear 52 is operatively attached to the extension rod 48. The second pawl gear 54 is attached to the outer casing 42, in which the second pawl gear 54 is operatively connected to the first pawl gear 52. The bit connector 56 is attached to the distal end of the arm 40, in which the bit connector 56 is operatively connected to the second pawl gear 54.

An optional protection skirt 58 may be added to the device, in which the protection skirt 58 is attached to the outer casing 42 so that the protection skirt 58 is slidably attached around the distal end of the housing 14. The protection skirt 58 may be made of any material, such as rubber.

The cogwheel 44 may have any number of flanges. One preferred configuration is that the cogwheel 44 has three flanges 46 defining two recesses around the circumference of the cogwheel 44. Another preferred configuration is that the cogwheel 44 has four flanges 46 defining three recesses around the circumference of the cogwheel 44. Yet another preferred configuration is that the cogwheel 44 has five flanges 46 defining four recesses around the circumference of the cogwheel 44. Still yet another preferred configuration is that the cogwheel 44 has six flanges 46 defining five recesses around the circumference of the cogwheel 44. The alignment of the flanges on the cogwheel 44 may be any orientation wherein one preferred configuration of the recesses being disposed circumferentially about the cogwheel 44 at approximately thirty-degree intervals whereby the arm 40 may be angularly oriented relatively to the handle 12 generally at thirty-degree increments.

The size of the arm 40 of the device 10 may be any dimension. One preferred configuration is that the arm 40 has a length of less than six inches. Another preferred configuration is that the arm 40 has a length of less than five inches. Still another preferred configuration is that the arm 40 has a length less than four inches.

Another preferred embodiment of the air wrench device 10 consist essentially of a handle 12 pivotally attached to an arm 40 and a protection skirt 58. The handle 12 includes: a housing 14, an air intake nozzle 16, an air driven motor 18, a drive shaft 20, a ball bearing collar 22, a universal joint 24, an on/off button 26, a trigger switch 28, a directional throw switch 30, a lock pin 32, a spring 36, and a pivot post 38. The air intake nozzle 16 is attached to the housing 14, the housing 14 having a distal end and a proximate end. The air driven motor 18 is attached to the proximate end of the housing 14, in which the air driven motor 18 is operatively attached to the air intake nozzle 16. The drive shaft 20 is operatively attached to the air driven motor 18. The ball bearing collar 22 is attached to the proximate end of the housing 14, in which the ball bearing collar 22 is operatively attached to the drive shaft 20. The universal joint 24 is operatively attached to the drive shaft 20. The on/off button 26 is attached to the housing 14, in which the on/off button 26 is operatively attached to the air driven motor 18. The trigger switch 28 is pivotally attached to the housing 14, in which the trigger switch 28 is operatively attached to the on/off button 26. The directional throw switch 30 is attached to the housing 14, in which the directional throw switch 30 is operatively attached to the air driven motor 18. When the directional throw switch 30 is slid into a first position then the drive shaft 20 is enabled to rotate in a clockwise direction. When the directional throw switch 30 is slid in a second position then the drive shaft 20 is enabled to rotate in a counterclockwise direction. The lock pin 32 is slidably attached within a crevice in the distal end of the housing 14, in which the lock pin 32 has an engagement head 34. When the lock pin 32 is slid toward the proximate end of the housing 14 then the lock pin 32 is in an unlocked alignment. When the lock pin 32 is slid towards the distal end of the housing 14 then the lock pin 32 is in a locked alignment. The spring 36 is attached to the housing 14 and is attached to the lock pin 32, wherein when the lock pin 32 is in the unlocked alignment then the spring 36 is in a compressed mode. The pivot post 38 is attached to the distal end of the housing 14. The arm 40 includes: an outer casing 42, an extension rod 48, a ball bearing sleeve 50, a first pawl gear 52, a second pawl gear 54, and a bit connector 56. The outer casing 42 has a distal end and a proximate end, in which the distal end of the outer casing 42 has a cogwheel 44. The cogwheel 44 is pivotally attached to the pivot post 38 of the handle 12, wherein the cogwheel 44 has a plurality of flanges 46 attached along the circumference of the cogwheel 44 so that each adjacent pair of flanges 46 defines a corresponding recess between the adjacent pair of flanges 46. The engagement head 34 of the lock pin 32 is insertable into anyone recess of the cogwheel 44, so that when the engagement head 34 of the lock pin 32 is inserted within anyone recess of the cogwheel 44 then the arm 40 is in a lock position relative to the handle 12, and when the engagement head 34 of the lock pin 32 is not inserted within anyone recess of the cogwheel 44 then the arm 40 is rotatable about the pivot post 38. The extension rod 48 is operatively attached to the universal joint 24 of the handle 12. The ball bearing sleeve 50 is attached to the outer casing 42, in which the ball bearing sleeve 50 operatively attached to the extension rod 48. The first pawl gear 52 is operatively attached to the extension rod 48. The second pawl gear 54 is attached to the outer casing 42, in which the second pawl gear 54 is operatively connected to the first pawl gear 52. The bit connector 56 is attached to the distal end of the arm 40, in which the bit connector 56 is operatively connected to the second pawl gear 54. The protection skirt 58 is attached to the outer casing 42, in which the protection skirt 58 is slidably attached around the distal end of the housing 14.

One preferred configuration of a method of using an air wrench device 10 comprising the steps of adjoining, affixing, aligning, allowing, enshrouding, getting, moving, obtaining, putting, rotating, shifting, squeezing, and tightening. The obtaining step comprises obtaining the device 10 comprising: a handle 12, the handle 12 including: a housing 14; an air intake nozzle 16 attached to the housing 14, the housing 14 having a distal end and a proximate end; an air driven motor 18 attached to the proximate end of the housing 14, the air driven motor 18 operatively attached to the air intake nozzle 16; a drive shaft 20 operatively attached to the air driven motor 18; a ball bearing collar 22 attached to the proximate end of the housing 14, the ball bearing collar 22 operatively attached to the drive shaft 20; a universal joint 24 operatively attached to the drive shaft 20; an on/off button 26 attached to the housing 14, the on/off button 26 operatively attached to the air driven motor 18; a trigger switch 28 pivotally attached to the housing 14, the trigger switch 28 operatively attached to the on/off button 26; a directional throw switch 30 attached to the housing 14, the directional throw switch 30 is operatively attached to the air driven motor 18, when the directional throw switch 30 is slid into a first position then the drive shaft 20 is enabled to rotate in a clockwise direction, when the directional throw switch 30 is slid in a second position then the drive shaft 20 is enabled to rotate in a counterclockwise direction; a lock pin 32 slidably attached within a crevice in the distal end of the housing 14, the lock pin 32 having an engagement head 34, when the lock pin 32 is slid toward the proximate end of the housing 14 then the lock pin 32 is in an unlocked alignment, when the lock pin 32 is slid towards the distal end of the housing 14 then the lock pin 32 is in a locked alignment; a spring 36 attached to the housing 14 and attached to the lock pin 32, wherein when the lock pin 32 is in the unlocked alignment then the spring 36 is in a compressed mode; and a pivot post 38 attached to the distal end of the housing 14; an arm 40 attached to the pivot post 38 of the handle 12, the arm 40 including: an outer casing 42 having a distal end and a proximate end, the distal end of the outer casing 42 having a cogwheel 44, the cogwheel 44 is pivotally attached to the pivot post 38 of the handle 12, the cogwheel 44 having a plurality of flanges 46 attached along the circumference of the cogwheel 44, each adjacent pair of flanges 46 defining a corresponding recess between the adjacent pair of flanges 46, wherein the engagement head 34 of the lock pin 32 is insertable into anyone recess of the cogwheel 44, when the engagement head 34 of the lock pin 32 is inserted within anyone recess of the cogwheel 44 then the arm 40 is in a lock position relative to the handle 12, when the engagement head 34 of the lock pin 32 is not inserted within anyone recess of the cogwheel 44 then the arm 40 is rotatable about the pivot post 38; an extension rod 48 operatively attached to the universal joint 24 of the handle 12; a ball bearing sleeve 50 attached to the outer casing 42, the ball bearing sleeve 50 operatively attached to the extension rod 48; a first pawl gear 52 operatively attached to the extension rod 48; a second pawl gear 54 attached to the outer casing 42, the second pawl gear 54 is operatively connected to the first pawl gear 52; and a bit connector 56 attached to the distal end of the arm 40, the bit connector 56 is operatively connected to the second pawl gear 54; and a protection skirt 58 attached to the outer casing 42, the protection skirt 58 is slidably attached around the distal end of the housing 14. The affixing step comprises affixing a pressurized air line to the air intake nozzle 16 attached to the housing 14. The getting step comprises getting a socket having a distal end and a proximate end. The adjoining step comprises adjoining the proximate end of the socket onto the bit connector 56 of the device 10. The moving step comprises moving slidably the lock pin 32 towards the proximate end of the housing 14 into the unlocked alignment so that the engagement head 34 of the lock pin 32 is not inserted within anyone recess of the cogwheel 44 wherein enabling the arm 40 to be rotatable about the pivot post 38. The rotating step comprises rotating the arm 40 into a bent alignment relative to the handle 12 when the engagement head 34 of the lock pin 32 is not inserted within anyone recess of the cogwheel 44 when the arm 40 is enabled to rotate about the pivot post 38. The allowing step comprises allowing the spring 36 to move the engagement head 34 of the lock pin 32 into one of the recesses of the cogwheel 44 when the arm 40 is rotated in the bent alignment relative to the handle 12, wherein locking the arm 40 is in the lock position relative to the handle 12. The enshrouding step comprises enshrouding the distal end of the socket around a head of a threaded bolt when the proximate end of the socket is adjoined to the bit connector 56 of the device 10 and when the arm 40 of the device 10 is in the lock position relative to the handle 12. The aligning step comprises aligning the shank of the threaded bolt over the threaded hole when the distal end of the socket enshrouds the head of the threaded bolt. The putting step comprises putting the directional throw switch 30 attached to the housing 14 into the first position so that the drive shaft 20 is enabled to rotate in a clockwise direction when the shank of the threaded bolt is aligned over the threaded hole. The squeezing step comprises squeezing pivotally the trigger switch 28 so that the on/off button 26 activates the motor 18 when the distal end of the socket enshrouds the head of the threaded bolt, when the shank of the threaded bolt is aligned over the threaded hole, and when the throw switch 30 is in the first position, wherein the threaded bolt is screwed into the threaded hole. The shifting step comprises shifting the directional throw switch 30 attached to the housing 14 into the second position so that the drive shaft 20 is enabled to rotate in a counterclockwise direction. The tightening step comprises tightening down pivotally onto the trigger switch 28 so that the on/off button 26 activates the motor 18, when the distal end of the socket enshrouds the head of the threaded bolt, when the directional throw switch 30 is attached shifted to the second position, when the threaded bolt is screwed into the threaded hole, so that the threaded bolt screwed into the threaded hole is unscrewed from the threaded hole.

Referring now to FIG. 1 which depicts a side plan view of a preferred embodiment of the wrench device 10 showing a handle 12 pivotally attached to an arm 40 and a protection skirt 58. The handle 12 is shown including: a housing 14, an air intake nozzle 16, an on/off button 26, a trigger switch 28, a directional throw switch 30, a lock pin 32, and a pivot post 38. The arm 40 is shown rotatable relative to the handle. The components of the arm 40 shown are outer casing 42, and a bit connector 56. The outer casing 42 is shown having a plurality of flanges 46 attached along the circumference of the cogwheel 44 so that each adjacent pair of flanges 46 defines a corresponding recess between the adjacent pair of flanges 46. The engagement head 34 of the lock pin 32 is shown inserted into one recess of the cogwheel 44, so that when the engagement head 34 of the lock pin 32 is inserted within anyone recess of the cogwheel 44 then the arm 40 is in a lock position relative to the handle 12. The bit connector 56 is shown attached to the distal end of the arm 40. The protection skirt 58 is shown attached to the outer casing 42 so that the protection skirt 58 is slidably attached around the distal end of the housing 14.

Figure 2:
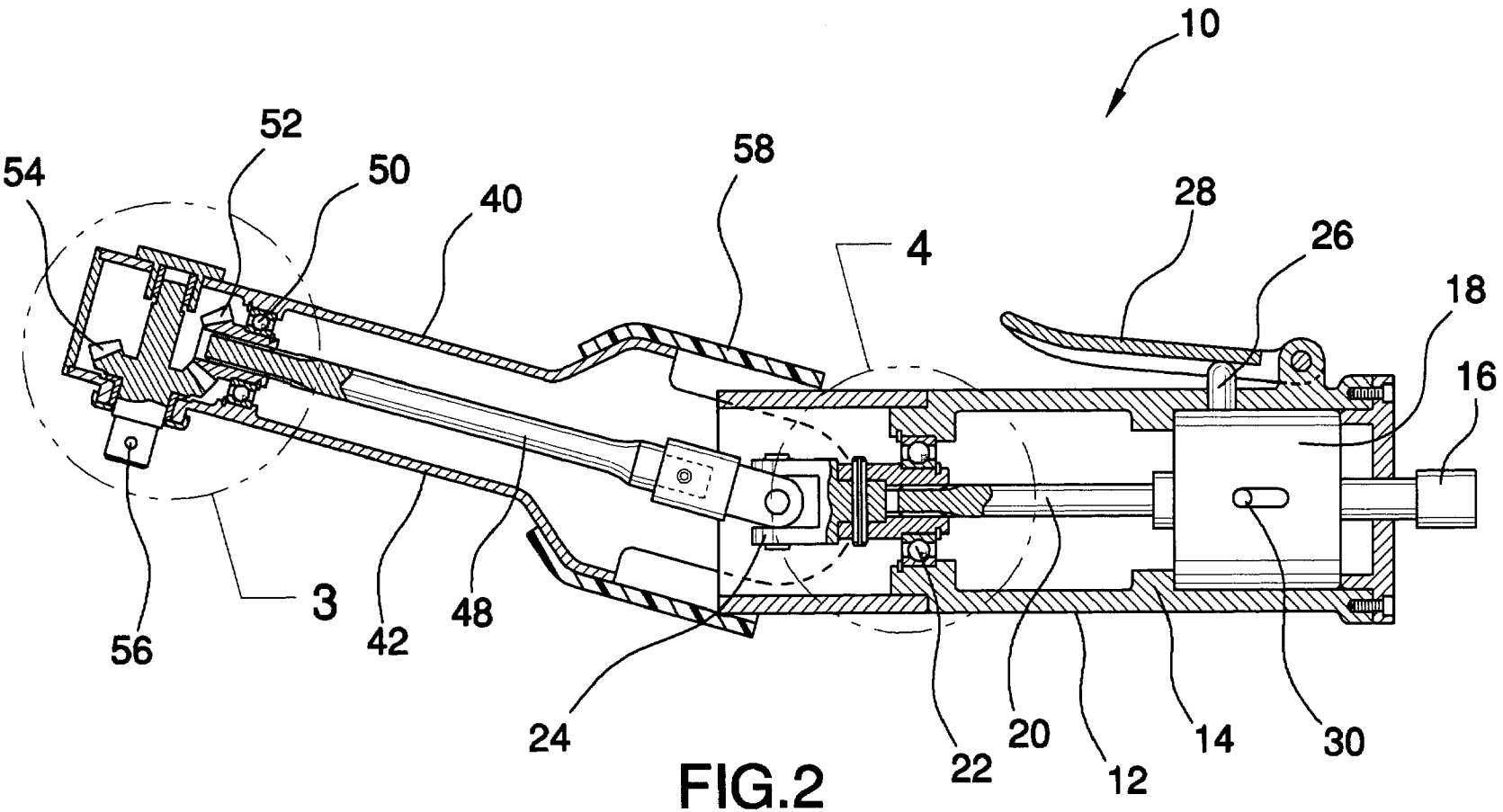
FIG. 2 is a cross sectional side view of a preferred embodiment of the wrench device of the present invention.

Refer now to FIG. 2, which depicts a cross sectional side view of a preferred embodiment of the wrench device 10 showing a handle 12 pivotally attached to an arm 40 and a protection skirt 58. The handle 12 is shown to include: a housing 14, an air intake nozzle 16, an air driven motor 18, a drive shaft 20, a ball bearing collar 22, a universal joint 24, an on/off button 26, a trigger switch 28, and a directional throw switch 30. The arm 40 is shown to include: an outer casing 42, an extension rod 48, a ball bearing sleeve 50, a first pawl gear 52, a second pawl gear 54, and a bit connector 56. The protection skirt 58 is shown attached to the outer casing 42 so that the protection skirt 58 is slidably attached around the distal end of the housing 14.

Figure 3:
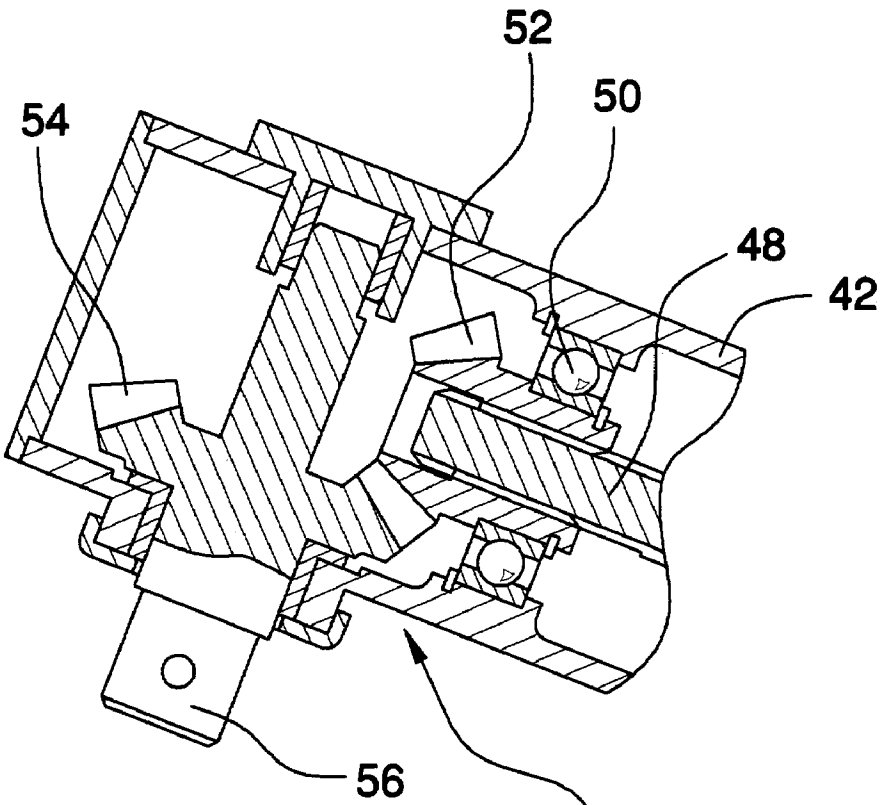
FIG. 3 is a closeup cross sectional side view of a preferred embodiment of the wrench device of the present invention.

Referring now to FIG. 3 which depicts a closeup cross sectional side view of a preferred embodiment of the wrench device 10 showing the distal end of the arm 40 having an outer casing 42, an extension rod 48, a ball bearing sleeve 50, a first pawl gear 52, a second pawl gear 54, and a bit connector 56.

Figure 4:
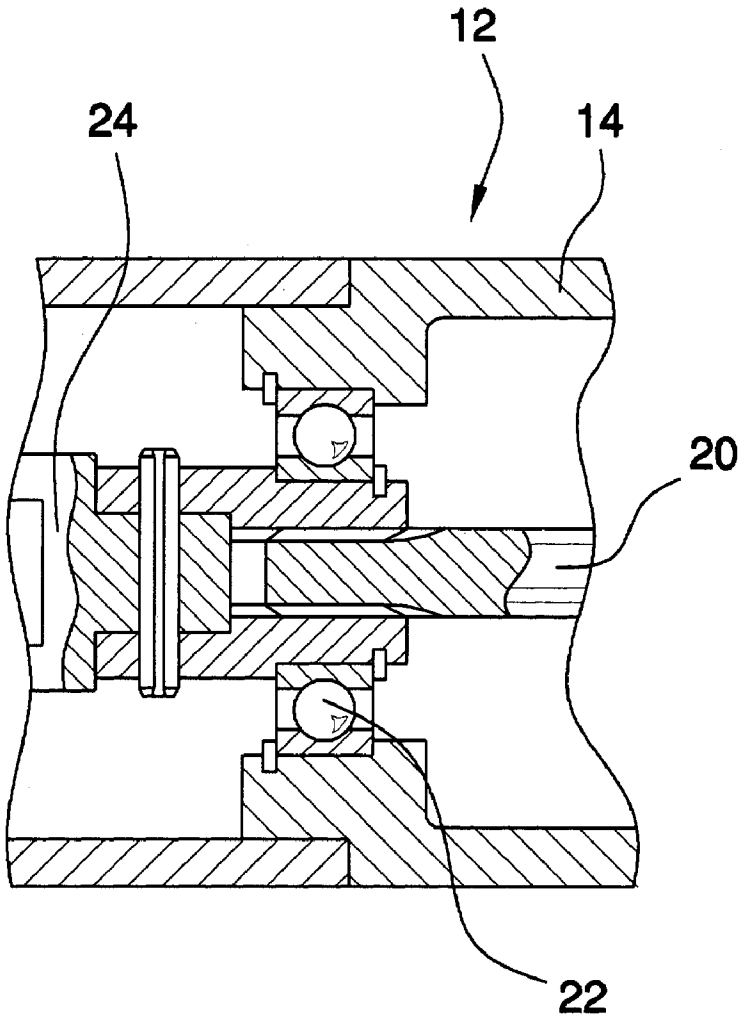
FIG. 4 is a closeup cross sectional side view of a preferred embodiment of the wrench device of the present invention.

Referring now to FIG. 4 which depicts a closeup cross sectional side view of a preferred embodiment of the wrench device 10 showing the distal end of the handle 12 having a housing 14, a drive shaft 20, a ball bearing collar 22, and a universal joint 24.

Figure 5:
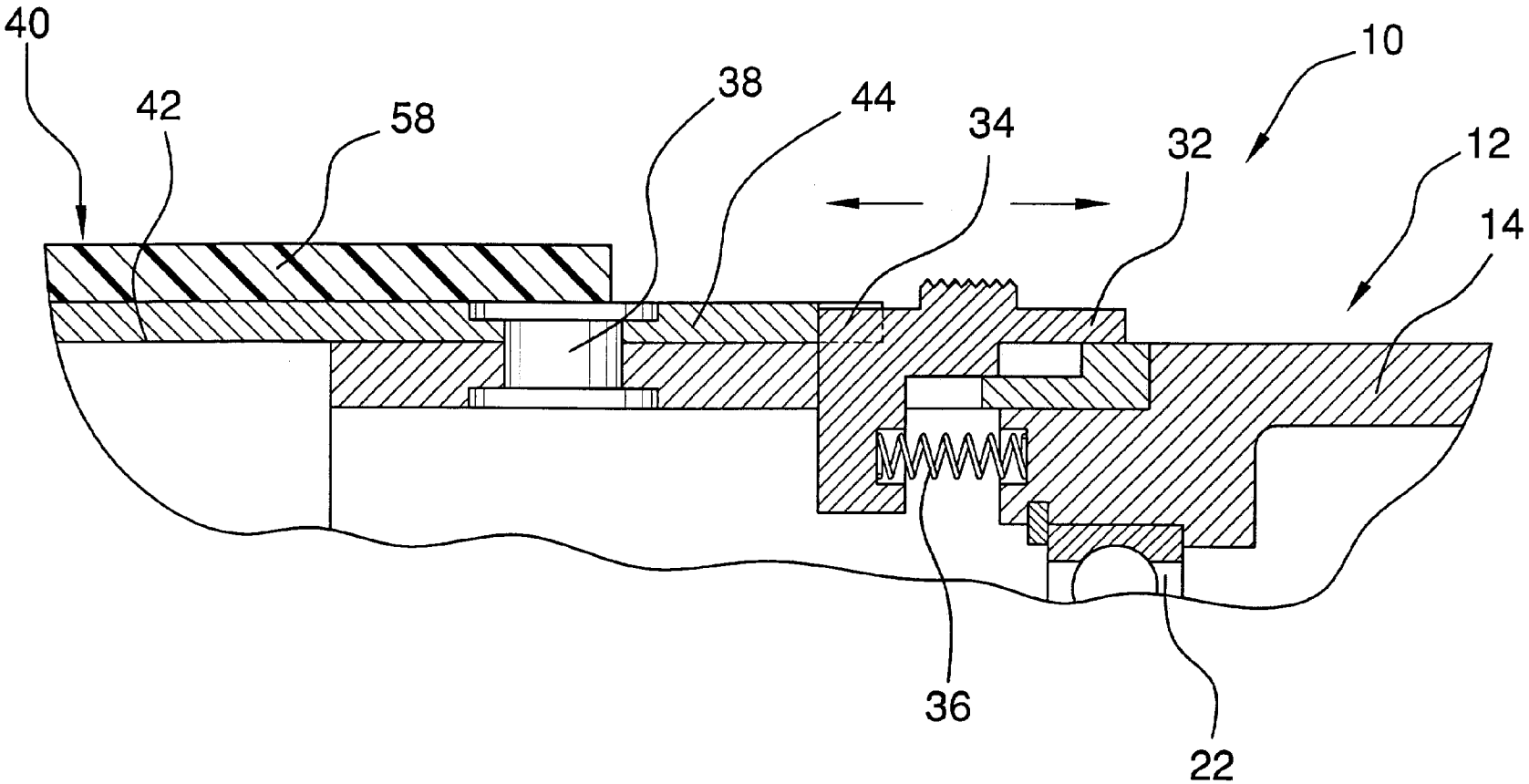
FIG. 5 is a closeup cross sectional side view of a preferred embodiment of the wrench device of the present invention.

Referring now to FIG. 5 which depicts a closeup cross sectional side view of a preferred embodiment of the wrench device 10 showing the handle 12 pivotally attached to an arm 40. The handle 12 is shown to include: a housing 14, a ball bearing collar 22, a lock pin 32, a spring 36, and a pivot post 38. The arm 40 is shown coupled to the handle 12 via the pivot post 38. The arm is shown to include: an outer casing 42 having a cogwheel 44 in which the cogwheel 44 is pivotally attached to the pivot post 38 of the handle 12.

As to the manner of usage and operation of the present invention, the same should be apparent from the above description. Accordingly, no further discussion relating to the manner of usage and operation will be provided.

While a preferred embodiment of the wrench device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of using an air wrench device comprising the steps of:

obtaining the device comprising:

a handle, the handle including:

a housing;

an air intake nozzle attached to the housing, the housing having a distal end and a proximate end;

an air driven motor attached to the proximate end of the housing, the air driven motor operatively attached to the air intake nozzle;

a drive shaft operatively attached to the air driven motor;

a ball bearing collar attached to the proximate end of the housing, the ball bearing collar operatively attached to the drive shaft;

a universal joint operatively attached to the drive shaft;

an on/off button attached to the housing, the on/off button operatively attached to the air driven motor;

a trigger switch pivotally attached to the housing, the trigger switch operatively attached to the on/off button;

a directional throw switch attached to the housing, the directional throw switch is operatively attached to the air driven motor, when the directional throw switch is slid into a first position then the drive shaft is enabled to rotate in a clockwise direction, when the directional throw switch is slid in a second position then the drive shaft is enabled to rotate in a counterclockwise direction;

a lock pin slidably attached within a crevice in the distal end of the housing, the lock pin having an engagement head, when the lock pin is slid toward the proximate end of the housing then the lock pin is in an unlocked alignment, when the lock pin is slid towards the distal end of the housing then the lock pin is in a locked alignment;

a spring attached to the housing and attached to the lock pin, wherein when the lock pin is in the unlocked alignment then the spring is in a compressed mode; and a pivot post attached to the distal end of the housing;

an arm attached to the pivot post of the handle, the arm including:

an outer casing having a distal end and a proximate end, the distal end of the outer casing having a cogwheel, the cogwheel is pivotally attached to the pivot post of the handle, the cogwheel having a plurality of flanges attached along the circumference of the cogwheel, each adjacent pair of flanges defining a corresponding recess between the adjacent pair of flanges, wherein the engagement head of the lock pin is insertable into anyone recess of the cogwheel, when the engagement head of the lock pin is inserted within anyone recess of the cogwheel then the arm is in a lock position relative to the handle, when the engagement head of the lock pin is not inserted within anyone recess of the cogwheel then the arm is rotatable about the pivot post;

an extension rod operatively attached to the universal joint of the handle;

a ball bearing sleeve attached to the outer casing, the ball bearing sleeve operatively attached to the extension rod;

a first pawl gear operatively attached to the extension rod;

a second pawl gear attached to the outer casing, the second pawl gear is operatively connected to the first pawl gear; and a bit connector attached to the distal end of the arm, the bit connector is operatively connected to the second pawl gear; and a protection skirt attached to the outer casing, the protection skirt is slidably attached around the distal end of the housing;

affixing a pressurized air line to the air intake nozzle attached to the housing;

getting a socket having a distal end and a proximate end;

adjoining the proximate end of the socket onto the bit connector of the device;

moving slidably the lock pin towards the proximate end of the housing into the unlocked alignment so that the engagement head of the lock pin is not inserted within anyone recess of the cogwheel wherein enabling the arm to be rotatable about the pivot post;

rotating the arm into a bent alignment relative to the handle when the engagement head of the lock pin is not inserted within anyone recess of the cogwheel when the arm is enabled to rotate about the pivot post;

allowing the spring to move the engagement head of the lock pin into one of the recesses of the cogwheel when the arm is rotated in the bent alignment relative to the handle, wherein locking the arm is in the lock position relative to the handle;

enshrouding the distal end of the socket around a head of a threaded bolt when the proximate end of the socket is adjoined to the bit connector of the device and when the arm of the device is in the lock position relative to the handle;

aligning the shank of the threaded bolt over the threaded hole when the distal end of the socket enshrouds the head of the threaded bolt;

putting the directional throw switch attached to the housing into the first position so that the drive shaft is enabled to rotate in a clockwise direction when the shank of the threaded bolt is aligned over the threaded hole;

squeezing pivotally the trigger switch so that the on/off button activates the motor when the distal end of the socket enshrouds the head of the threaded bolt, when the shank of the threaded bolt is aligned over the threaded hole, and when the throw switch is in the first position, wherein the threaded bolt is screwed into the threaded hole;

shifting the directional throw switch attached to the housing into the second position so that the drive shaft is enabled to rotate in a counterclockwise direction; and tightening down pivotally onto the trigger switch so that the on/off button activates the motor, when the distal end of the socket enshrouds the head of the threaded bolt, when the directional throw switch is attached shifted to the second position, when the threaded bolt is screwed into the threaded hole, so that the threaded bolt screwed into the threaded hole is unscrewed from the threaded hole.

* * * * *